United States Patent [19]

Schewe

[11] 4,312,482

[45] Jan. 26, 1982

[54] AUTO-LOADING TENSION COMPENSATOR

[75] Inventor: Richard A. Schewe, Rockford, Ill.

[73] Assignee: Barber-Colman Company, Rockford, Ill.

[21] Appl. No.: 78,279

[22] Filed: Sep. 24, 1979

[51] Int. Cl.[3] ..... B65H 59/26

[52] U.S. Cl. ..... 242/154

[58] Field of Search ..... 242/154, 153, 147 R, 242/45, 18 PW, 18 R

[56] References Cited

U.S. PATENT DOCUMENTS

| | | | |
|---|---|---|---|
| 2,104,809 | 1/1938 | O'Dowd | 242/154 X |
| 2,326,714 | 8/1943 | Wholton | 242/154 |
| 2,685,417 | 8/1954 | Bartelson | 242/154 X |
| 2,833,491 | 5/1958 | Carroll | 242/154 |
| 3,080,132 | 3/1963 | Fisher et al. | 242/154 |
| 3,191,885 | 6/1965 | Jones et al. | 242/154 |
| 3,295,788 | 1/1967 | Richter | 242/154 |
| 3,318,551 | 5/1967 | Parks et al. | 242/154 |
| 4,133,493 | 1/1979 | Schewe | 242/154 |

FOREIGN PATENT DOCUMENTS

| | | | |
|---|---|---|---|
| 122209 | 1/1960 | France | 242/154 |
| 627044 | 10/1961 | Italy | 242/154 |
| 22908 | 11/1900 | Switzerland | 242/154 |

*Primary Examiner*—Stanley N. Gilreath
*Attorney, Agent, or Firm*—Robert M. Hammes

[57] ABSTRACT

A tension compensator for use on a package winder has two spaced pins projecting from a rotatable member about an axis, the pins extending generally in the direction of the axis. The member is biased to rotate in a predetermined direction toward a stop so that a strand passed between and over said pins in a zig-zag fashion moves the pins against the bias to straighten the strand under higher tension and permit the bias to move the pins to store the strand under lower tension. The compensator has a strand guide for guiding the strand preparatory to loading in a path forwardly displaced from the pins. An actuator is provided to rotate said member to a loading position and to thereafter release the strand from the strand guide so that it drops between the pins whereby the strand is loaded between and over said pins in zig-zag fashion.

11 Claims, 8 Drawing Figures

AUTO-LOADING TENSION COMPENSATOR

BACKGROUND OF THE INVENTION

This invention relates to tension or strand-length compensation in strand winding operations, and particularly the winding of a strand on a conical core to form a strand package. More particularly, the invention relates to such compensators which may be automatically loaded.

When packages are formed by winding a strand in a helix on a package core, the length of the strand between the supply and the package is not constant since the distance from the supply to the ends of the package are greater than the distance to the intermediate locations. This resuls in uneven tension in the strand on the package which may produce undesirable changes in the physical properties of the strand as well as unsatisfactory formation of the strand package itself. This condition is exaggerated in cone winding because the peripheral speed of the conical package core varies continuously from one end to the other even through the angular velocity is constant. This condition exists to varying degrees whether the strand is fed to the winding station at either variable or fixed rates. However, the problems are particularly evident when the strand is fed at a fixed rate to the winding station, as, for example, in the winding of yarn produced by open end spinning wherein the yarn is fed to the winding station at a fixed rate determined by the feed of the yarn withdrawal rolls.

In order to remedy this problem, tension compensators have been employed to store strand when the tension is low and to release strand from storage when the tension is high. Many such compensators have two spaced pins or projections mounted on a member rotatable about a fixed axis, the pins extending generally in the direction of, substantially parallel to and on opposite sides of the axis. The member is biased to rotate in a predetermined direction and the strand between the supply and the package is threaded over one pin and under the other in a zig-zag manner such that tension in the strand exerts force on the pins tending to rotate the member in opposition to its bias. The bias typically may be adjusted so that it overcomes the force of the strand on the pins when tension is low, thereby storing strand, and the bias is overcome by the force of the strand on the pins when tension is high, thereby releasing strand from storage. Thus, in winding conical packages, the compensator will store strand when the strand is traversed toward a small end of the cone and will release strand when the strand is traversed toward the large end of the cone.

Since manual loading or threading of the strand through the tension compensator is considerably time consuming, it is desirable to provide a means for self-loading or automatic loading of the tension compensator. One such self-loading tension compensator is disclosed in Richard A. Schewe's U.S. Pat. No. 4,133,493.

In order to accommodate variations in the strength of different strands encountered in winding different types of yarn and to accommodate cones of different sizes which may be used in package winding, it is desirable to employ a compensator having a greater range of strand storing capabilities beyond that which can be obtained simply by adjusting the bias on the rotatable member. Such increased range can be achieved by designing the compensators so that the rotatable member and its associated pins can oscillate through a larger angle. It has been found that the self-threading feature disclosed in Schewe's U.S. Pat. No. 4,133,493 is not completely satisfactory when the range of rotation of the rotatable member is substantially increased. Consequently, there has been a need for a tension compensator having a greater range of compensation which can be reliably automatically loaded or threaded-up.

SUMMARY OF THE INVENTION

According to the instant invention a tension compensator of the type described is provided with an auto-loading mechanism suitable for use with such tension compensators having enhanced range of operation. The compensator is provided with a strand guide surface adapted to maintain a running strand displaced forwardly from the pins or projections extending from the rotatable member of the compensator preparatory to loading. An actuator is provided to rotate the member and its associated pins to a loading position and to thereafter release the strand from the guide surface so that it drops between the pins such that after the rotatable member is released by the actuator the strand is passed between and over the pins in zig-zag fashion as previously described.

According to the peferred embodiment, the strand release means comprises a laterally slidable member having a strand guiding surface which may be selectively moved out of engagement with the strand. A linearly movable actuator is provided which is adapted to selectively engage and rotate the rotatable member to the strand loading position as the actuator is moved linearly. In addition, as the actuator approaches the strand loading position, it engages a portion of the release member so as to move the release member laterally out of engagement with the strand. The strand thereafter falls between the pins as previously described. The actuator is so constructed that it is operable either manually or by automated equipment associated with the winding apparatus. The invention thus permits loading or threading-up of a tension compensator of the type described in a simple, quick, one-step operation when the compensator is provided with an auto-loading mechanism according to the invention.

A more complete understanding of the invention and its operation, as well as other objects and advantages, will be apparent from the following detailed description of the invention taken in conjunction with the drawing figures.

DETAILED DESCRIPTION OF THE PREFERRED EMBODIMENT

Figure 1:
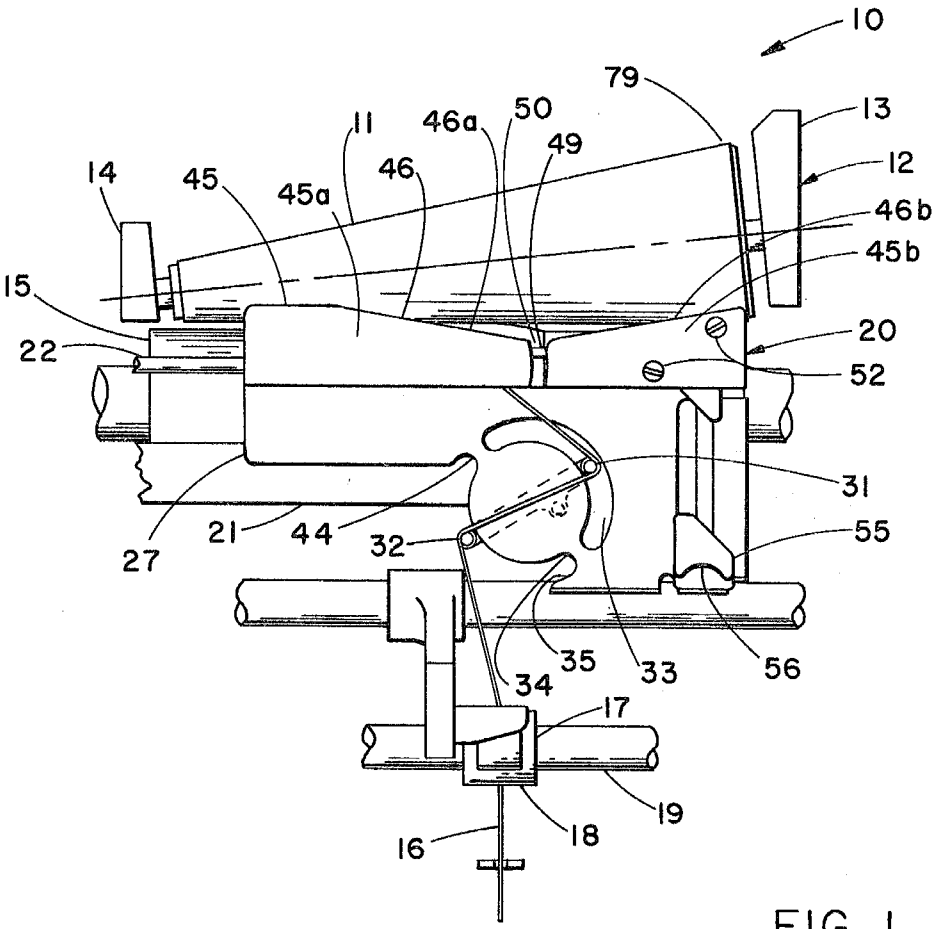
FIG. 1 is a front elevation of a typical winding station including an auto-loading tension compensator according to the invention, the compensator being threaded-up for strand package winding.

As shown in FIG. 1 a typical winding station 10, as may be employed in an open end spinning machine, comprises a conical package core 11 supported in package support apparatus 12 between spaced arms 13, 14. Package core 11 is driven through frictional engagement with rotating drive roll 15. The strand 16, such as spun yarn, is delivered to core 11 and drive roll 15 at a fixed rate by withdrawal rolls 17, 18. Draw roll 18 is fixed to driven shaft 19 and withdrawal roll 17 is a pressure roll in frictional engagement with withdrawal roll 18, strand 16 running between the withdrawal rolls.

Figure 2:
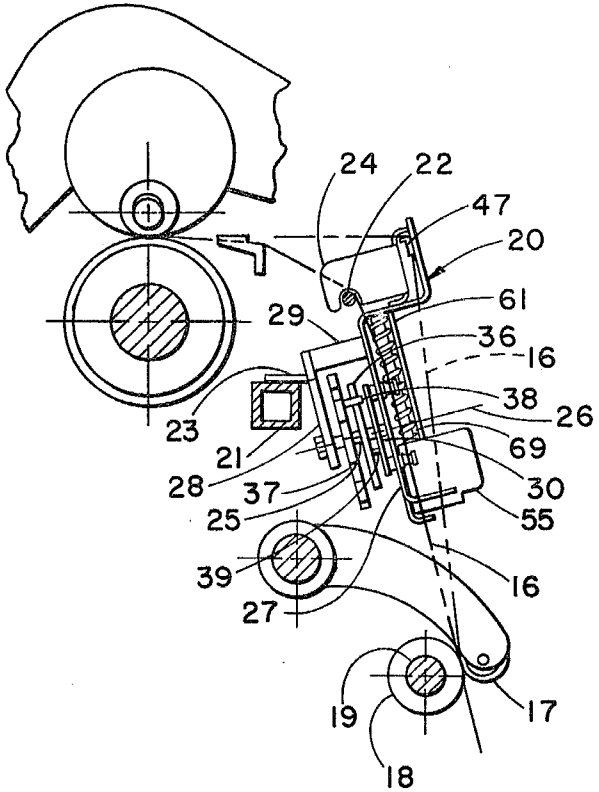
FIG. 2 is an end view of the winding station of FIG. 1 with the near package support arm removed showing a loaded compensator and the strand in phantom in position preparatory to loading.
Figure 4:
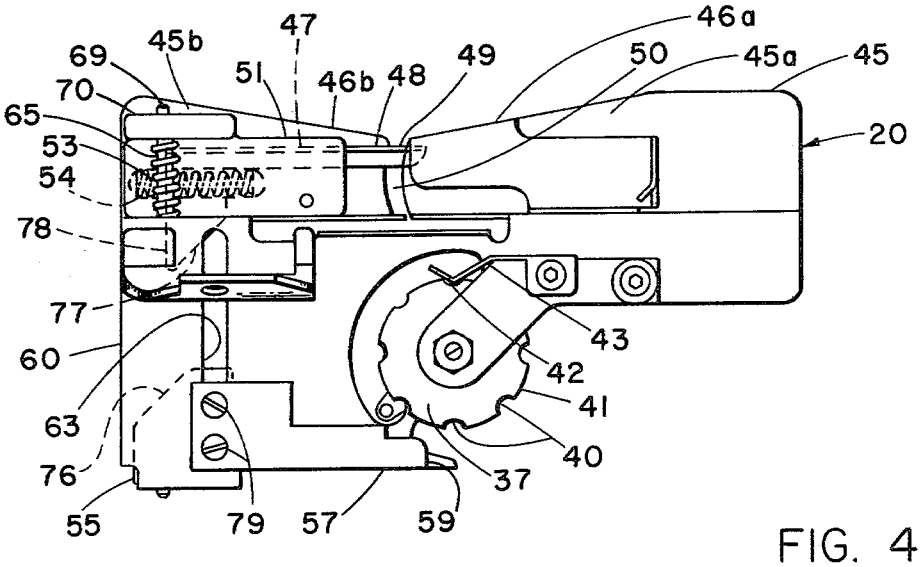
FIG. 4 is a rear view of the tension compensator shown in FIG. 2.

An auto-loading tension compensator 20 is mounted on support 21 and guide rod 22 of the machine between withdrawal rolls 17, 18 and package core 11 by means of mounting brackets 23 and 24, as shown in FIGS. 1 and 2. Compensator 20 is provided with a pivot shaft 25 which rotates freely about an axis 26 between a base 27 and a parallel bar 28. The bar is held in spaced relation to the base by spacer 29. A member 30 rotatable about axis 26, is fixed on pivot shaft 25. A pair of projections 31, 32, shown as pins, extend from rotatable member 30 generally in the direction of axis 26 and are preferably in spaced parallel relation to axis 26. Projections 31, 32 are preferably hardened to resist wear and polished to present a smooth, non-abrasive strand-engaging surface. Projection 31 extends through an arcuate slot 33 in base 27. In similar manner, projection 32 extends through arcuate slot 34 in base 27. As shown, a substantial portion of the outer wall 35 of slot 34 has been cut away. Base 27 could easily be formed with slot 34 being complete. A biasing means shown as clock spring 36, which has one end fixed to disc 37 by means of pin 38 and the other end connected to a rearwardly extending pin 39 on member 30. Disc 37 is freely rotatable about shaft 25 and has a plurality of notches 40 in its periphery 41 for selectively receiving a detent 42 on the end of a leaf spring 43 cantilevered between bar 28 and spacer 29. The clock spring 36 is installed such that the rotatable member 30 and its associated projections 31, 32 are biased to rotate clockwise when viewed from the front as seen in FIG. 1. Clockwise rotation is limited by stop 44, shown as the end of arcuate slot 34 upon contact by projection 32. The tension in clock spring 36 may be increased by rotating disc 37 counterclockwise when compensator 20 is viewed from the back, as seen in FIG. 4, and decreased by rotating the disc clockwise. Disc 37 is retained in a selected position by detent 42, becoming pressed against periphery 41 by leaf spring 43, becoming engaged with a selected one of notches 40, thereby determining the tension in clock spring 36. The apparatus so far described is known in the prior art.

Figure 3:
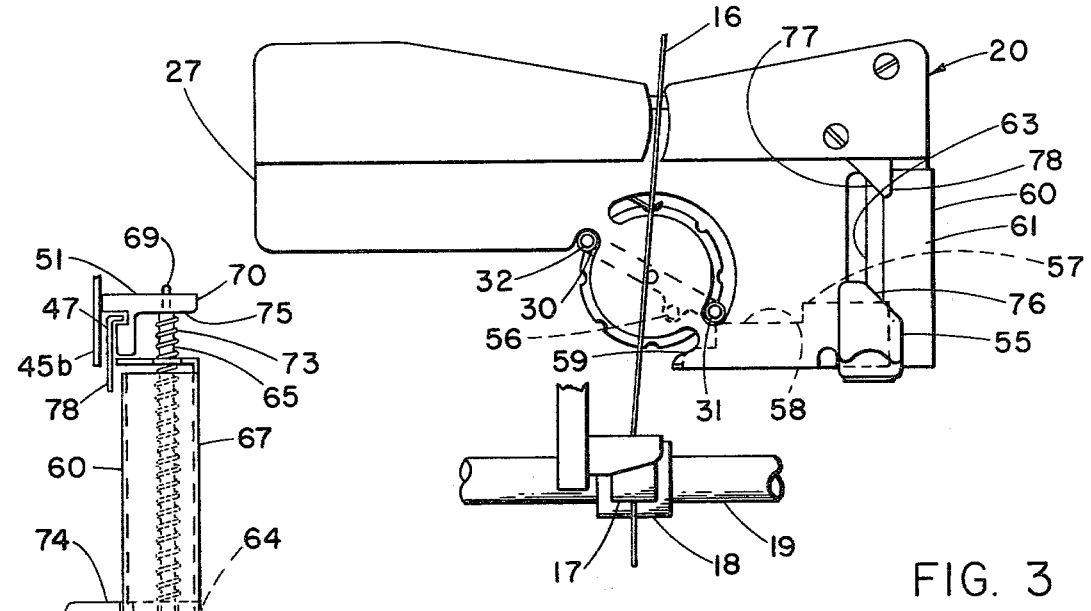
FIG. 3 is a front elevation of the preferred embodiment of an auto-loading tension compensator according to the invention in the position preparatory to strand loading.

Referring to FIGS. 1 and 2, compensator 20 is provided with a strand guide 45 having a guide surface 46, which may comprise sloping top edge portions 46*a* and 46*b* of respective strand guide portions 45*a* and 45*b*, positioned to maintain the strand 16 in a path forwardly displaced from projections 31, 32, as shown in phantom in FIG. 2, preparatory to loading of compensator 20. Guiding edge portions 46*a*, 46*b* slope downwardly toward a medial portion of guide 45 so that the strand riding on guide surface 46 tends to move toward a medial position and thus be approximately centrally located for loading, as shown in FIG. 3. Means is provided to release strand 16 from guide surface 46 to permit loading of compensator 20. In the preferred embodiment, this release means comprises release member 47, best seen in FIG. 4, which has an end portion 48 with a top surface 49 forming a portion of guide surface 46 which is selectively movable between strand guiding and release positions. As shown, guide portions 45*a*, 45*b* of strand guide 45 are spaced apart to define a slot 50 at a medial portion of strand guide 45. Release member 47 is movable laterally out of engagement with strand 16 so that the strand may fall through slot 50 to facilitate loading. Release member 47 is retained in position behind guide portion 45*b* by means of retaining block 51 which is held in position by screws 52 which are shown in FIG. 1. Release member 47 is biased toward slot 50 by any suitable means such as spring 53 located in cavity 54 of retaining block 51.

Figure 8:
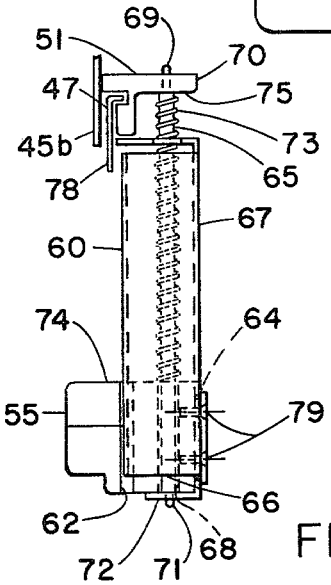
FIG. 8 is a right end view of a portion of the compensator showing mounting of the actuator.
Figure 5:
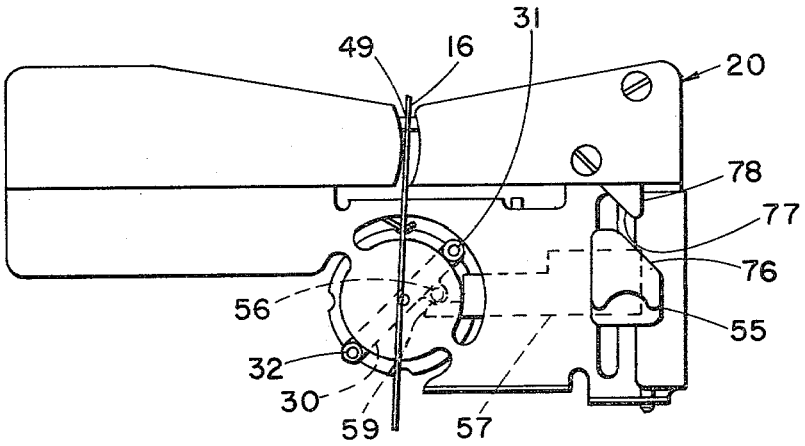
FIG. 5 is a view of the tension compensator shown in FIG. 2 showing the actuator in position to engage a stub on the rotating member.
Figure 6:
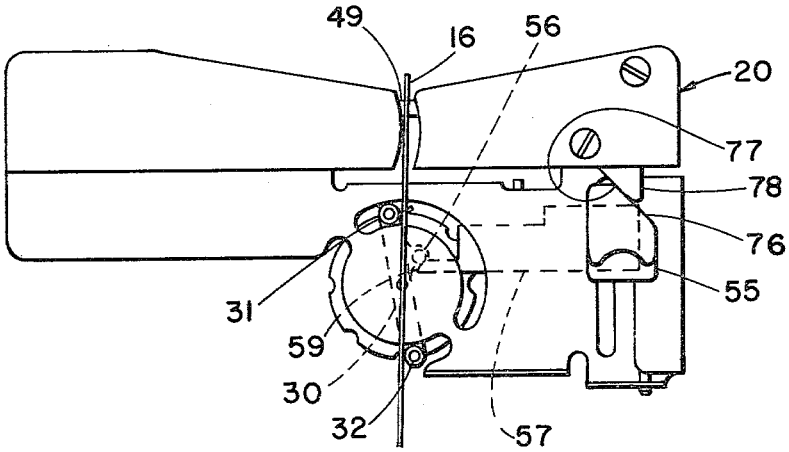
FIG. 6 is a view of the tension compensator shown in FIG. 2 showing the actuator engaging the release member.

Compensator 20 is also provided with means for selectively rotating member 30 to a loading position. The details of construction of this rotating means are discussed primarily with reference to FIGS. 3, 4 and 8. In the preferred embodiment this rotating means comprises actuator 55 which has a relieved portion 56 to facilitate operation of the actuator either manually or with automated equipment by pushing upward on relieved portion 56. Actuator 55 is provided with a laterally projecting actuator arm 57, shown in FIGS. 3–7, having a surface 58 adapted to engage pin 31 of rotatable member 30. Arm 57 is further provided with an end portion 59 adapted to engage a stub 56 of rotatable member 30, as best seen in FIG. 5. Base 27 is provided with an actuator mounting portion 60 having a linear rib 61 extending substantially vertically. Actuator 55 is provided with a slot 62 for receiving linear rib 61 which thereby serves as a guide for linear movement of actuator 55. Mounting portion 60 is further provided with a mounting slot 63 for receiving a guide portion 64 projecting rearwardly from actuator 55. Arm 57 is secured to guide portion 64 by screws 79. A substantially vertical guide rod 65 is positioned within the enclosure formed by rib 61, end wall 66 and back wall 67 of mounting portion 60, extending through an opening 68 in actuator 55. Guide rod 65 is retained in position at its top end by rod mounting portion 69 of retaining block 51, pin 69 extending through portion 70 as shown in FIG. 8. Rod 65 is retained in position at its bottom end by pin 7, extending through base 72 of actuator mounting portion 60. A spring 73 fits over rod 65 and abuts against top surface 74 of actuator 55 and bottom surface 75 of rod mounting portion 69 so as to bias actuator 55 toward the position shown in FIG. 3.

While separate means may be employed to move release member 47 to its release position, actuator 55 is preferably adapted to operate release member 47 simultaneously as it moves member 30 to the strand loading position. In order to accomplish this, actuator 55 is further provided with an inclined cam surface 76 which is adapted to engage follower surface 77 of depending extension 78 of release member 47.

The operation of the auto-loading feature of compensator 20 will now be described in more detail. In a typical winding operation, a creeling tail 79 is formed on package core 11 before the compensator is threaded up for the package winding operation. Following formation of the creeling tail, strand 16 is released from a fixed guide (not shown) and then is carried by the sloping edge portion 46b of guide surface 46 toward the medial portion of guide 45 where it is then guided by top surface 49 of release member 47. This position of the strand will be referred to as the loading position. When the strand is in the loading position it is approximately centrally located forward of projections 31, 32. Similar preparatory positioning can take place from either side of guide 45 upon piece-up after a yarn break.

Figure 7:
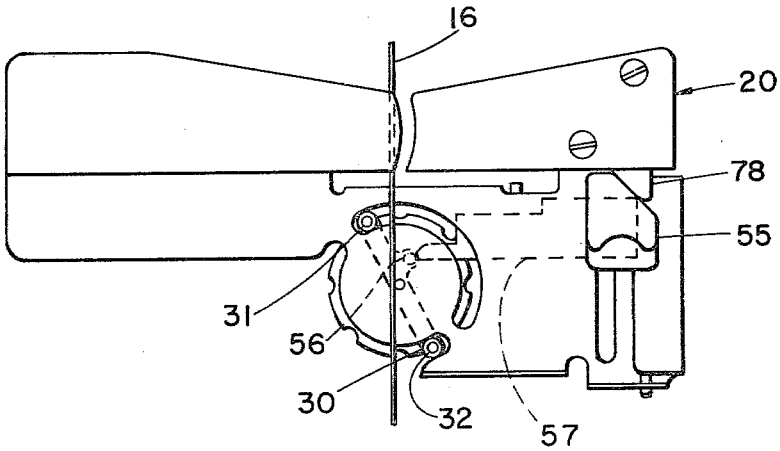
FIG. 7 is a view of the tension compensator shown in FIG. 2 showing the actuator in the loading position.

In order to automatically load tension compensator 20, actuator 55 is moved from the inactive position shown in FIG. 3 to the loading position shown in FIG. 7. As is apparent from FIG. 3, initial vertical movement of actuator 55 will cause top surface 58 of arm 57 to engage projection 31 so as to initiate counter-clockwise rotation of member 30. As seen in FIG. 5, further movement of actuator 55 results in end portion 59 of actuator arm 57 engaging stub 56 of member 30 and projection 31 becomes disengaged from surface 58. Continuing movement toward the position shown in FIG. 6, cam surface 76 begins to engage follower surface 77. When actuator 55 has been moved to the loading position shown in FIG. 7, member 30 has been rotated so that strand 16 can be dropped between projections 31, 32. Simultaneously, release member 47 has been moved laterally out of engagement with strand 16 due to relative movement between cam surface 76 and the follower surface 77. Thus, when actuator 55 is moved to the loading position release member 47 is simultaneously moved out of engagement with strand 16 thereby permitting the strand to drop between projections 31, 32. Thereafter releasing actuator 55 permits the actuator to return to the inactive position out of engagement with member 30. When released, member 30 rotates clockwise due to the bias exerted by clock spring 36 and the compensator 20 is threaded up so that the strand passes between and over projections 31, 32 in zig-zag fashion as shown in FIG. 1. Compensator 20 has thus been automatically loaded so that the normal package winding operation may proceed.

It will be readily apparent to those skilled in the art that alternate embodiments may be employed without departing from the scope and spirit of the invention which is to be limited solely by the claims.

I claim:

1. An auto-loading tension compensator for use in winding a strand upon a package, said compensator comprising a fixed axis, a member rotatable about said axis, said member having a pair of projections spaced from said axis and having respective smooth thread-engaging surfaces, means for biasing said member to rotate in a predetermined direction about said axis, and a stop for limiting rotation of said member in the predetermined direction, wherein the improvement comprises:

a strand guide having a guide surface spaced from said projections for maintaining the strand in a path displaced forwardly from said projections in the direction of said axis and for positioning the strand for loading;

means for selectively rotating said member in opposition to said biasing means to a strand-loading position; and means for releasing the strand from said guide surface when said member is in said strand-loading position so that the strand lies between said projections and is engageable by said projections when said member rotates in response to said biasing means.

2. An auto-loading tension compensator according to claim 1 wherein said guide surface extends transverse to said axis.

3. An auto-loading tension compensator according to claim 2 wherein said guide surface comprises a pair of sloped opposing surface portions which converge to a medial strand positioning portion of said guide surface.

4. An auto-loading tension compensator according to claim 1 wherein said release means includes a portion of said guide surface selectively movable between strand guiding and release positions.

5. An auto-loading tension compensator according to claim 4 wherein said release means includes a release member movable transverse to said axis between guiding and release positions, said movable guide surface portion being part of and movable with said release member.

6. An auto-loading tension compensator according to claim 5 wherein said release member is biased toward said guiding position.

7. An auto-loading tension compensator according to claim 5 wherein said release member has a cam follower and said compensator additionally comprises an actuator selectively movable between inactive and strand-releasing positions, said actuator having a cam surface arranged to engage said cam follower when said actuator is moved to the strand-releasing position whereby said release member is moved to the release position.

8. An auto-loading tension compensator according to claim 7 wherein said actuator is biased toward said inactive position.

9. An auto-loading tension compensator according to claim 1 wherein said rotating means comprises an actuator linearly movable between an inactive position and a strand-loading position, said actuator adapted to engage said rotatable member so as to rotate said member to the loading position when said actuator is moved from the inactive position to the strand loading position.

10. An auto-loading tension compensator according to claim 9 wherein said actuator is biased toward said inactive position.

11. An auto-loading tension compensator according to claim 1 wherein said rotating means comprises an actuator linearly movable between inactive and strand-loading positions and said release means comprises a release member movable transverse to said axis between guiding and release positions, a portion of said release member comprising a portion of said guide surface, said release member having a cam follower surface, said actuator having a cam surface engageable with said cam follower surface when said actuator is moved toward the strand-loading position and a portion adapted to engage a portion of said rotatable member so as to rotate said member to the strand-loading position when such actuator is moved to the strand-loading position.

* * * * *